US005433080A

United States Patent [19]

Boeckel

[11] Patent Number: 5,433,080

[45] Date of Patent: Jul. 18, 1995

[54] THERMOELECTRIC COOLING CENTRIFUGE

[76] Inventor: John W. Boeckel, 1232 Georgia Hill Rd., Southbury, Conn. 06488-0358

[21] Appl. No.: 204,561

[22] Filed: Mar. 2, 1994

Related U.S. Application Data

[63] Continuation-in-part of Ser. No. 581,597, Sep. 12, 1990.

[51] Int. Cl.[6] ..... F25B 21/02

[52] U.S. Cl. ..... 62/3.6; 62/3.2; 62/428

[58] Field of Search ..... 62/3.2, 3.3, 3.6, 3.64, 62/3.62, 428

[56] References Cited

U.S. PATENT DOCUMENTS 2,922,284 1/1960 Danielson et al. ..... 62/3.3

3,174,291 3/1965 Crawford et al. ..... 62/3.64

*Primary Examiner*—John M. Sollecito

*Attorney, Agent, or Firm*—Eric P. Schellin

[57] ABSTRACT

A centrifuge chamber is provided with a plurality of thermoelectric cooling devices having heat sinks with fins mounted vertically concentric with respect to the rotor of the centrifuge between the centrifuge chamber and outer side walls of the housing. The top of the area defined by the housing is provided with a manifold cover for passage of cooling air emanating from a blower disposed in the cover. The cooling air passes through the manifold and then down through the fins to remove heat therefrom.

1 Claim, 3 Drawing Sheets

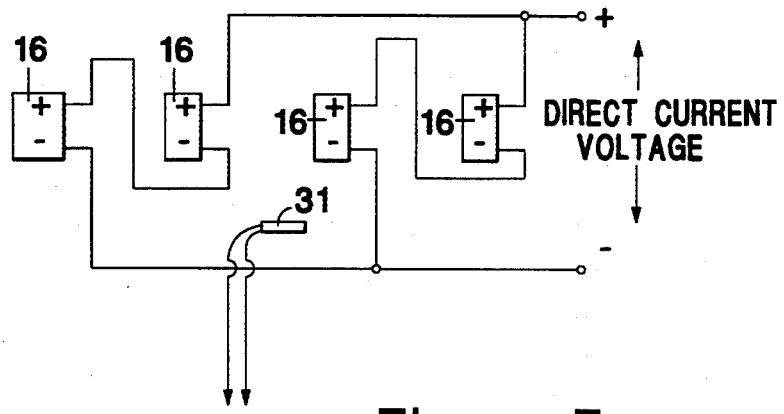
Figure 7
Figure 1
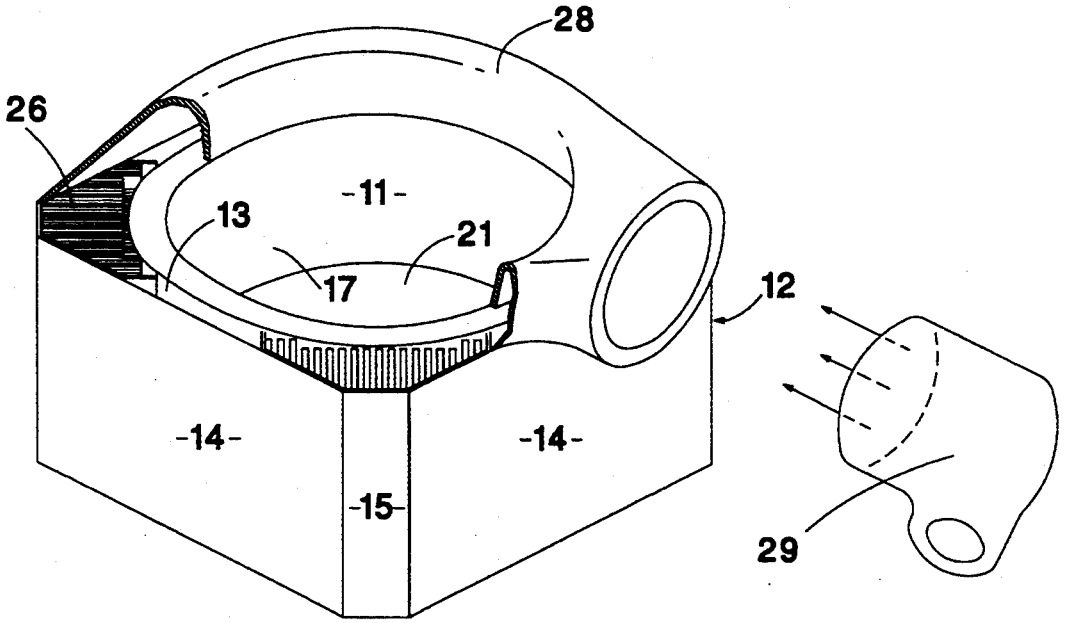

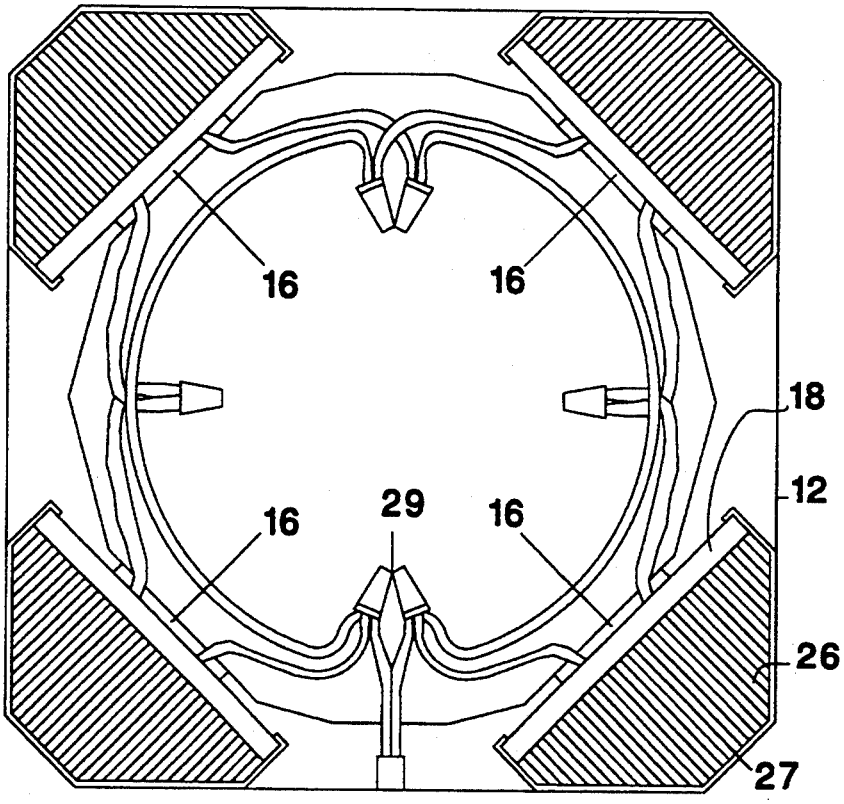
Figure 3
Figure 2
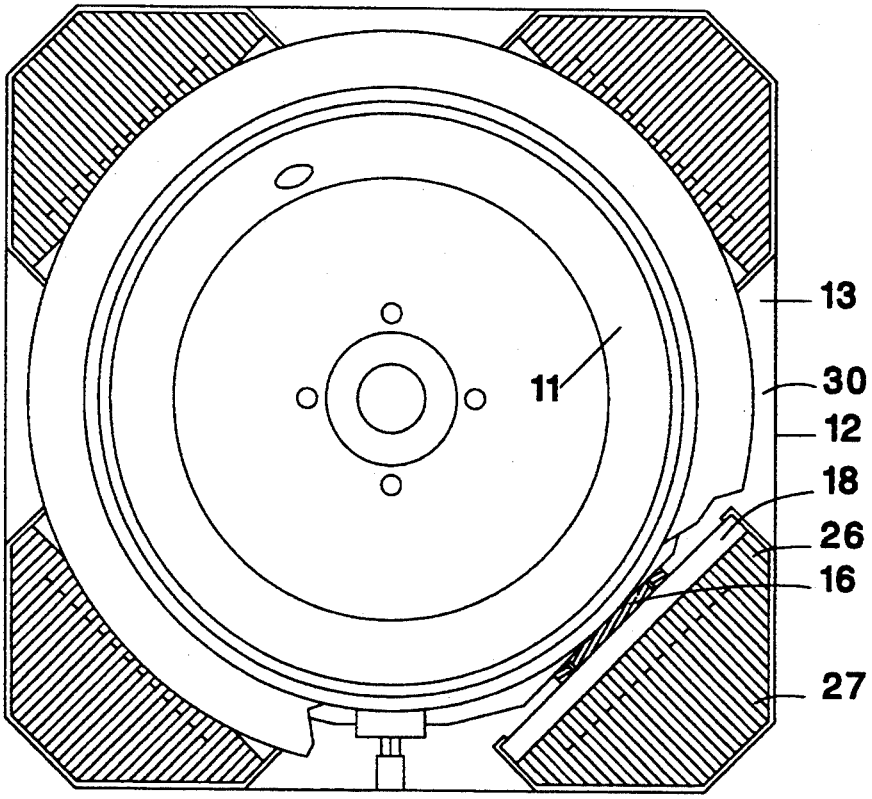

THERMOELECTRIC COOLING CENTRIFUGE

CROSS REFERENCE TO PRIOR APPLICATION

The present patent application is a continuation-in-part patent application of Ser. No. 07/581,597 filed Sep. 12, 1990, of the same inventor as herein, entitled: SAFETY INTERLOCK FOR LABORATORY CENTRIFUGES AND METHOD FOR ITS MANUFACTURE. The said prior application is incorporated herein in its entirety by reference.

BACKGROUND OF THE INVENTION

This invention relates to thermoelectric coolers preferably designed for installation with centrifuges. More particularly, the cooler is of the type having a heat sink over which ambient air is driven for the more efficient discharge of energy.

SUMMARY OF THE PRIOR ART

Wedemeyer et al U.S. Pat. No. 4,512,758 discloses the advantage of a nonconducting substrate grasping a plurality of thermoelectric modules of the Peltier effect type. The substrate with attached thermoelectric modules is clamped to the bottom of a centrifuging chamber on one side. By firmly impressing the chamber onto the heat sinks, efficient thermal conductivity and hence removal of heat from the chamber readily occurs. The device of Wedemeyer et al is slow in moving the heat content across the chamber thereby imposes an appreciable delay in cooling rotors to desired centrifuging temperatures.

In a more recent U.S. Pat. No. 4,785,637 to Giebeler, a thermoelectric temperature control assembly is disclosed wherein heat is transferred to or from a heat sink. The heat sink is located below the chamber containing the centrifuge rotor.

Most critically, the efficiency of the thermoelectric cooled is dependent upon the heat discharge from the thermoelectric cooler. Such heat discharge includes heat extracted from the chamber as well as heat produced in the thermoelectric cooler by the Peltier effect. Ordinary heat sinks have been found other than optimum for this required heat discharge effect. As a result, cooling has been undesirably slow.

SUMMARY OF THE INVENTION

A thermoelectric cooling design of the type having thermoelectric coolers. Provisions for a centrifuge chamber and improved heat dissipation from the thermoelectric coolers are provided. For improved thermal response, the refrigerated centrifuge chamber is provided with a motor driven fan to drive ambient air downwardly over a plurality of heat sinks mounted vertically concentric with respect to the rotor of the centrifuge.

In other words a heat discharge heat sink is communicated to each thermoelectric cooler for dissipating heat energy from both the chamber and the thermoelectric cooler.

Before centrifugation occurs with many samples, temperature thereof must be precisely controlled. In practice, classification of the sample in a rotor must occur at controlled temperature. An example of such a temperature is 2° centigrade for certain biological samples. The sample must be brought to the temperature and during centrifugation the sample must be maintained at the temperature. In both events cooling of the chamber is required. Due to their small size and weight, thermoelectric devices using the Peltier effect are utilized.

The chamber is typically produced from relatively pure nonalloyed aluminum of the thinnest size possible to thereby obtain heat conduction through the shortest path possible. A thin wall thickness has the advantage of improving thermal response times. Both the heat capacity of the chamber and the thermal gradient produed by the chamber in cooling the rotor are reduced.

Thermoelectric modules require high thermal conductivity between chamber heat sinks and discharge heat sinks. At the interface between a thermoelectric module and discharge heat sink, a critical high flow heat discharge junction is defined.

BRIEF DESCRIPTION OF THE DRAWINGS

Other objects, features, and advantages will become more apparent after referring to the following specification and attached drawings in which.

FIG. 1 is a top perspective in partial fragmentary form of the centrifuge chamber assembly of the present invention.

FIG. 2 is a top plan view of the centrifuge chamber with the top air distribution manifold removed.

FIG. 3 is a bottom plan view of the centrifuge chamber with the bottom removed.

FIG. 7 is a diagrammatic view of the electrical circuitry of the thermoelectric modules.

DETAILED DESCRIPTION OF THE INVENTION

Figure 6:
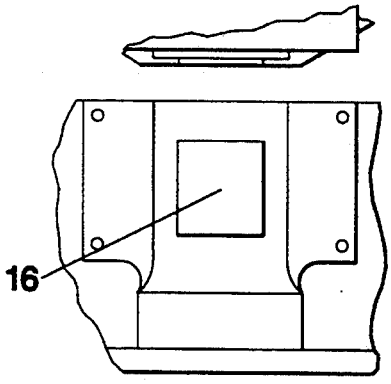
FIG. 6 is an enlarged fragmentary view of one of the thermoelectric elements used around the chamber.

Attention is now directed to the drawings especially to FIG. 1 which depicts a centrifuge generally shaped cylindrical chamber 11 and a generally shaped square housing 12 which surrounds said chamber 11 and defines a space 13 therefrom.

The housing 12 has a generally square shape having four upstanding side walls 14 with upstanding corner walls 15 therebetween. The chamber 11 has an annular wall 17. The chamber 11 is detailed to carry a conventional centrifugal rotor not shown. The chamber 11 has a bottom 21. The chamber 11 may be detailed to have a conventional cover (not shown) which may easily overlie and close the chamber 11 or it may be hermetically sealing whereby a vacuum may be applied internally of chamber 11 as desired.

The chamber 11 has in this configuration four thermoelectric modules 16 equidistantly spaced about externally of the chamber 11 but the cooling surface is in heat conducting relationship with the outer surface of the chamber 11 thereby effectively cooling the internal volume of the chamber 11 and the centrifuge rotor (not shown) contained therein.

Figure 4:
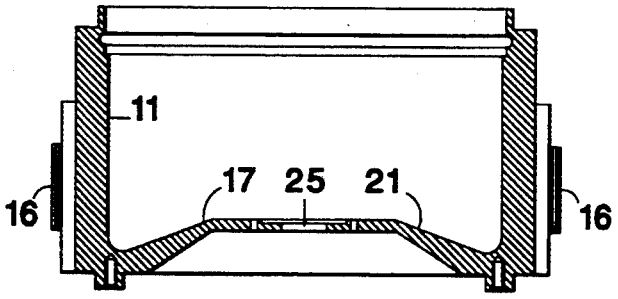
FIG. 4 is a cross sectional view of the chamber showing the thermoelectric modules.
Figure 5:
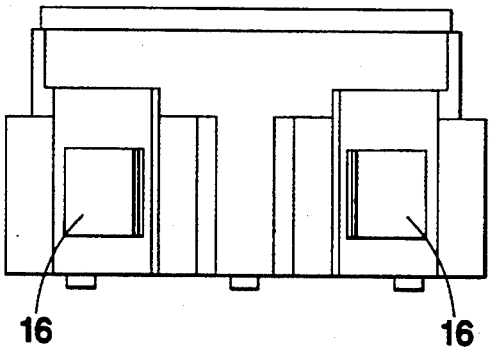
FIG. 5 is a side view of the chamber of the centrifuge without the outer shell.

Note from the cross-section of FIG. 4 that the cylindrical chamber 11 the floor 21 thereof has a truncated conical configuration with a bore 25 centrally therethrough. A shaft from a vertically upstanding electric motor (not shown) extends above the bottom 21. A conventional rotor is keyed to the said axle for rotation in a conventional manner. FIG. 4 also depicts portions of the thermoelectric modules 16. In FIG. 5 the chamber 11 is shown with a side view of two of such thermoelectric modules 16 which are in close association with the chamber 11 to achieve good thermal conduction with one side of the thermoelectric module and the can 11 surface. FIG. 6 is a close-up and enlarged view of such module. It is pointed out that the thermoelectric modules 16 are of conventional construction and commercially available.

As four thermoelectric modules 16 are employed, the heated side thereof is at the part extending away from the chamber 11. Note from FIGS. 2 and 3 that the thermoelectric modules 16 are located whereby they face the corners of the housing 12 containing the chamber 11 and as the housing 12 has, essentially, a substantially square configuration, space is thereby provided for a heat sink 26 for dissipation of heat. Note from FIG. 2 and 3 that the heated side of the thermoelectric modules 16 are each thermally connected to relatively large blocks 18 positioned tangentially with respect to the cylindrical chamber 11.

The area of the corners has a series of vertical fins 27 having each end thereof in uniform heat conducting relationship with the hot side of the thermoelectric module 16 through said blocks 18 and the other end position being designed to fill the space and terminate in juxtaposition with the inside of the square housing 12.

It is pointed out that the top of the area defined by the centrifuge and the square-like housing 12, i.e. having a somewhat annular configuration, is fitted with a manifold like cover 28 detailed to permit the flow of air therethrough and downwardly into the space defined by the vertically extending fins 27 whereby carry off heat downwardly from the thermoelectric modules 16. A source of moderately high velocity air emanates from a motor driven blower 29 of conventional structure and configuration. The manifold like cover 28 can be clearly seen in FIG. 1 where parts have been cut away.

FIG. 7 shows that two of each of the four thermoelectric modules 16 are in electrical series with each other while pairs of each are in parallel. Note FIG. 3 which shows the bottom of the device from whence one can see the wiring layout 29 showing two thermoelectric modules 16 in each side as being wired in series.

As space is also present between the area defined by the chamber, the housing and the thermoelectric modules it is pointed out that such space is filled with thermoplastic foam 30 such as polyurethane which is foamed in situ.

Note from FIG. 7 that a suitable conventional thermostat 31 is depicted which is selected whereby to control the degree of cooling.

What is claimed is:

1. A thermoelectrically cooled device for a centrifuge having a rotor comprising in combination an open bottomed centrifuge housing;

said centrifuge housing having a top portion;

a thermal conductive chamber adapted and constructed to contain a rotor of said centrifuge;

said thermal conductive chamber having a side;

said open bottomed centrifuge housing surrounding said chamber and in spaced relationship to said housing;

at least one thermoelectrically cooling module having a cooling side and a heating side;

said cooling side of said thermoelectric module being attached to said side of said chamber;

at least one heat sink attached to a heating side of said thermoelectric module to form a unitary and locally rigid structure with said chamber at the point of attachment;

said at least one thermoelectrically cooling module having a first heat receiving side communicated to said side of said chamber and having a heat discharge side for passing heat energy away from said chamber;

said heat discharge side including a plurality of vertical fins positioned in said space between said chamber and said housing communicated to each of said thermoelectric module at said heat discharge side for dissipating heat energy from said chamber and heat energy from said thermoelectric module;

said top portion of said housing having an air pressurizing means;

said top portion having a conduit for conveying the pressurized air and directing the pressurized air downwardly between said fins and out of the open portion of said housing to thereby remove heat.

* * * * *